US005382139A

United States Patent [19]

Kawaguchi et al.

[11] Patent Number: 5,382,139

[45] Date of Patent: Jan. 17, 1995

[54] GUIDING MECHANISM FOR RECIPROCATING PISTON OF PISTON TYPE COMPRESSOR

[75] Inventors: Masahiro Kawaguchi; Masanori Sonobe; Shigeki Kanzaki; Tomohiko Yokono, all of Kariya, Japan

[73] Assignee: Kabushiki Kaisha Toyoda Jodoshokki Seisakusho, Kariya, Japan

[21] Appl. No.: 104,858

[22] Filed: Aug. 11, 1993

[30] Foreign Application Priority Data

Aug. 21, 1992 [JP] Japan ..... 4-223085

[51] Int. Cl.[6] ..... F04B 1/12

[52] U.S. Cl. ..... 417/269; 91/499

[58] Field of Search ..... 417/269, 222.1; 91/486, 91/499; 92/154; 184/6.8

[56] References Cited

U.S. PATENT DOCUMENTS

| | | | |
|---|---|---|---|
| 2,929,551 | 3/1960 | Heidorn . | |
| 4,522,112 | 6/1985 | Nomura | 417/269 |
| 4,664,604 | 5/1987 | Terauchi | 417/222 |
| 4,963,074 | 10/1990 | Sanuki et al. | 417/222 |
| 5,032,060 | 7/1991 | Kobayashi et al. | 417/222.1 |
| 5,174,728 | 12/1992 | Kimura et al. | 417/269 |

FOREIGN PATENT DOCUMENTS

| | | | |
|---|---|---|---|
| 2005054 | 2/1972 | Germany . | |
| 2166411 | 4/1974 | Germany . | |
| 3121212 | 2/1982 | Germany . | |
| 3519332 | 10/1986 | Germany . | |
| 4207186 | 9/1992 | Germany . | |
| 62-133973 | 8/1987 | Japan . | |
| 0011165 | 1/1991 | Japan | 417/269 |
| 4-49676 | 4/1992 | Japan . | |

OTHER PUBLICATIONS

German Search Report in re P 43 27 948.1 dated 25 Jan. 1994, furnished by the German Patent Office with an Official Letter dated 2 Feb. 1994.

*Primary Examiner*—Richard A. Bertsch
*Assistant Examiner*—Alfred Basichas
*Attorney, Agent, or Firm*—Brooks Haidt Haffner & Delahunty

[57] ABSTRACT

An improved piston guiding mechanism for use in piston a type compressor is disclosed. The compressor includes a housing. A cylinder block having a bore is accommodated in the housing. A piston reciprocates within the cylinder bore. A refrigerant gas containing lubricant oil is sucked into the cylinder bore from outside, is compressed within the cylinder bore, and is discharged out of the compressor in accordance with reciprocating motion of the piston. A hollow section extends radially from the central portion to the peripheral surface of the piston, and opens to the peripheral surface. The hollow section moves between the interior of the housing and the cylinder bore in accordance with the reciprocating motion of the piston, and transfers the lubricant oil in the refrigerant gas from inside of the housing to the cylinder bore.

6 Claims, 4 Drawing Sheets

GUIDING MECHANISM FOR RECIPROCATING PISTON OF PISTON TYPE COMPRESSOR

BACKGROUND OF THE INVENTION

1. Field of the Invention

The present invention relates to a piston type compressor, in which fluid is compressed by means of reciprocating pistons connected to a swash plate. More particularly, it relates to a guiding mechanism for reciprocating pistons, which improves the slidability of the pistons in the compressor.

2. Description of the Related Art

Swash plate type compressors have a wide variety of applications including the use in an air conditioning system for automobile and/or a refrigerating system. Among those compressors, a single head piston type compressor is widely known, which compresses fluid by means of reciprocating pistons connected to a swash plate. A conventional single head piston type compressor is disclosed in the U.S. Pat. No. 4,664,604.

As shown in FIG. 6, a cylinder block 41 is accommodated in a cylindrical housing 40 of a compressor. Pistons 42 are accommodated in cylinder bores 41*a* and reciprocally movable therein, respectively. A drive shaft 44 is rotatably supported by means of the central portion of the cylinder block 41 and the front cover 43. The drive shaft is driven by an engine. A drive plate 45 is mounted on the drive shaft 44, and synchronously rotates with the shaft 44. Further, a swash plate 47 is tiltably mounted on the shaft 44, and is reciprocally slidable together with a spherical sleeve 46 along the axis direction of the shaft 44. The drive plate 45 and the swash plate 47 are connected, by means of a hinge mechanism 48. The circumference of the swash plate 47 is engaged with the proximal portion of the associate piston 42.

According to the above-described compressor, when the shaft 44 is rotated, the drive plate 45 is rotated together with the shaft. The rotation of the plate 45 is transferred to the swash plate 47 through the hinge mechanism 48. The plate 47 is rotated with the surface inclined with respect to the shaft, so that the pistons 42 reciprocate in the cylinder bores 41*a*, respectively. Therefore, the refrigerant gas sucked into an inlet chamber 52 is compressed, and discharged into an associate discharge chamber 53, respectively.

Control of the displacement of the compressor can be achieved by varying the stroke of the piston. The stroke of piston varies depending on the difference between pressures which are acting on both sides of the swash plate 47, respectively. The difference is generated by balancing the pressures between the pressure in a crank chamber 50 acting on the rear surface of the piston 42 and suction pressure in the cylinder bore 41*a* acting on the front surface of the piston 42, and acts on the swash plate 47, through the piston 42.

According to the conventional compressor, each one of the pistons 42 has a cylindrical shape. Further, connecting portions 51 for engaging shoes 49 are formed at the proximal portion of the pistons 42, respectively. The diameter or radius of curvature of the connecting portion 51 is substantially equal to that of the piston 42. Therefore, a gap hardly exists between the circumference of the connecting portion 51 and the inner wall of the housing 40. Even when the pistons 42 reciprocate, it is difficult to lead the refrigerant gas containing lubricant oil that is in the crank chamber 50 from the periphery of the connecting portion 51 to the slide portion of the cylinder bore which corresponds to the piston. The lack of lubrication at the slide portion will result in rapid wear, so that durability is lowered.

SUMMARY OF THE INVENTION

Accordingly, it is a primary objective of the present invention to provide a piston type compressor, in which the slidability of the pistons with respect to the associate cylinder bores is improved.

To achieve the foregoing and other objects in accordance with the purpose of the present invention, an improved piston guiding mechanism for use in a piston type compressor is provided. The piston guiding mechanism includes a housing. A cylinder block having a bore is accommodated in the housing. A piston reciprocates within the cylinder bore. A refrigerant gas containing lubricant oil is sucked into the cylinder bore from outside, is compressed within the cylinder bore, and is discharged out of the compressor in accordance with reciprocating motion of the piston. An oil transfer section extends radially from the central portion to the peripheral surface of the piston, and opens at the peripheral surface. The oil transfer section moves between the interior of the housing and the cylinder bore in accordance with the reciprocating motion of the piston, and transfers the lubricant oil in the refrigerant gas from inside of the housing to the cylinder bore.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings, in which:

FIGS. 1 through 5 illustrate an embodiment of the present invention, wherein:

FIG. 1 is a longitudinal cross-sectional view of a swash plate type variable displacement compressor according to an embodiment of the present invention;

FIG. 2 is a perspective view of a piston of the compressor as shown in FIG. 1;

FIG. 3 is a fragmentary cross-sectional view of a detail of the hinge mechanism of the compressor as shown in FIG. 1;

FIG. 4 is a cross-sectional view of the compressor of FIG. 1, showing further details of the hinge mechanism as shown in FIG. 3;

FIG. 5 is a cross-sectional view showing an assembled structure of the piston of the compressor as shown in FIG. 1.

DETAILED DESCRIPTION OF THE PREFERRED EMBODIMENT

A preferred embodiment according to the present invention will now be described referring to FIGS. 1 through 5.

Figure 1:
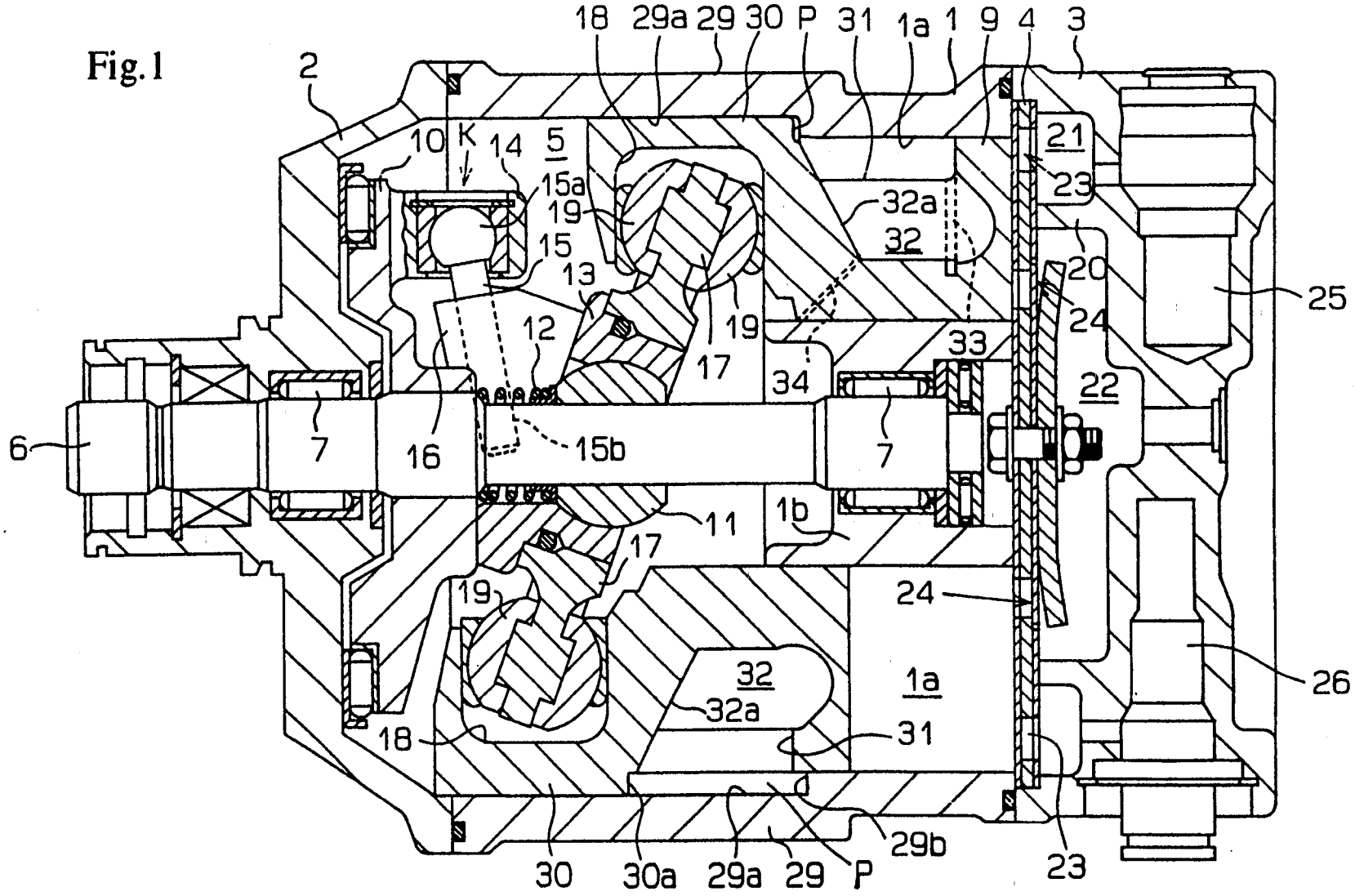

As shown in FIG. 1, a front housing 2 of the compressor is connected with the front end (i.e., left side of FIG. 1) of a center housing 1. A rear housing 3 is connected with the rear end (i.e., right side of FIG. 1) of the center housing 1, with a valve plate 4 interposed therebetween. A cylinder block 1*b* is accommodated in the center housing 1. A plurality of cylinder bores 1*a* are equiangularly formed in the cylinder block 1*b*. A crank chamber 5 is defined in the center housing 1 by the cylinder block 1*b*.

A drive shaft 6 is rotatably supported by means of radial bearings 7 disposed in the front housing 2 and cylinder block 1*b*, respectively, in the crank chamber 5. A plurality of pistons 9 are reciprocally movable and accommodated in the cylinder bores 1*a*, respectively. A drive plate 10 is mounted on the drive shaft 6. A spherical sleeve 11 is mounted on the shaft 6, and is horizontally (i.e., back-and-forth direction) slidable. This sleeve 11 is urged along the shaft 6 toward the cylinder block 1*b* by means of a coil spring 12. A rotary journal 13 is rotatably fitted around the spherical surface of the sleeve 11. The journal 13 is linked with the drive plate 10 by means of a hinge mechanism K, and is tiltable along the shaft 6 in the back-and-forth direction.

Figure 3:
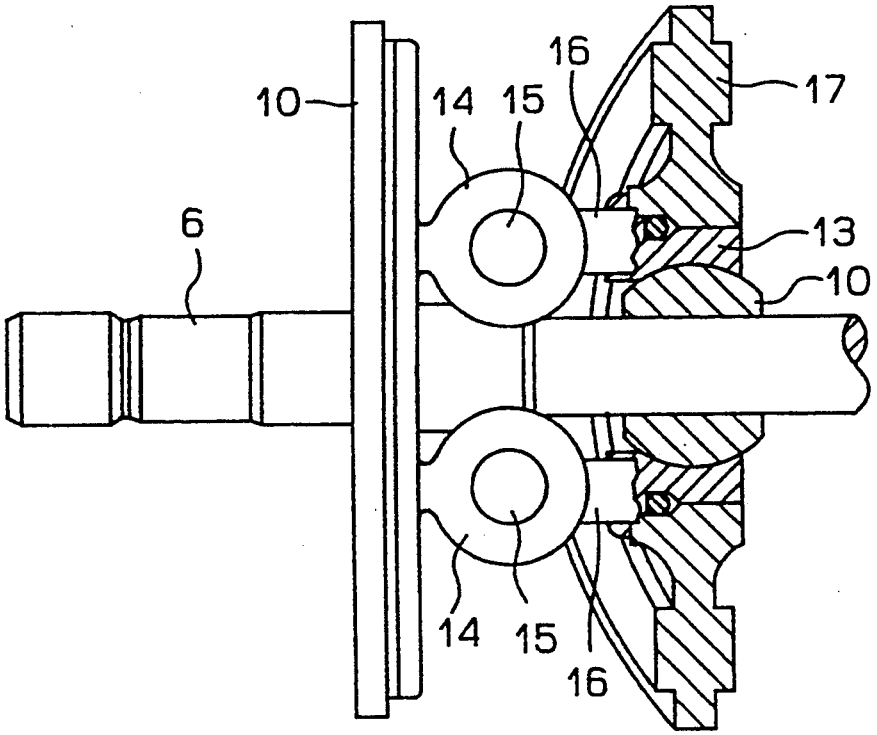
Figure 4:
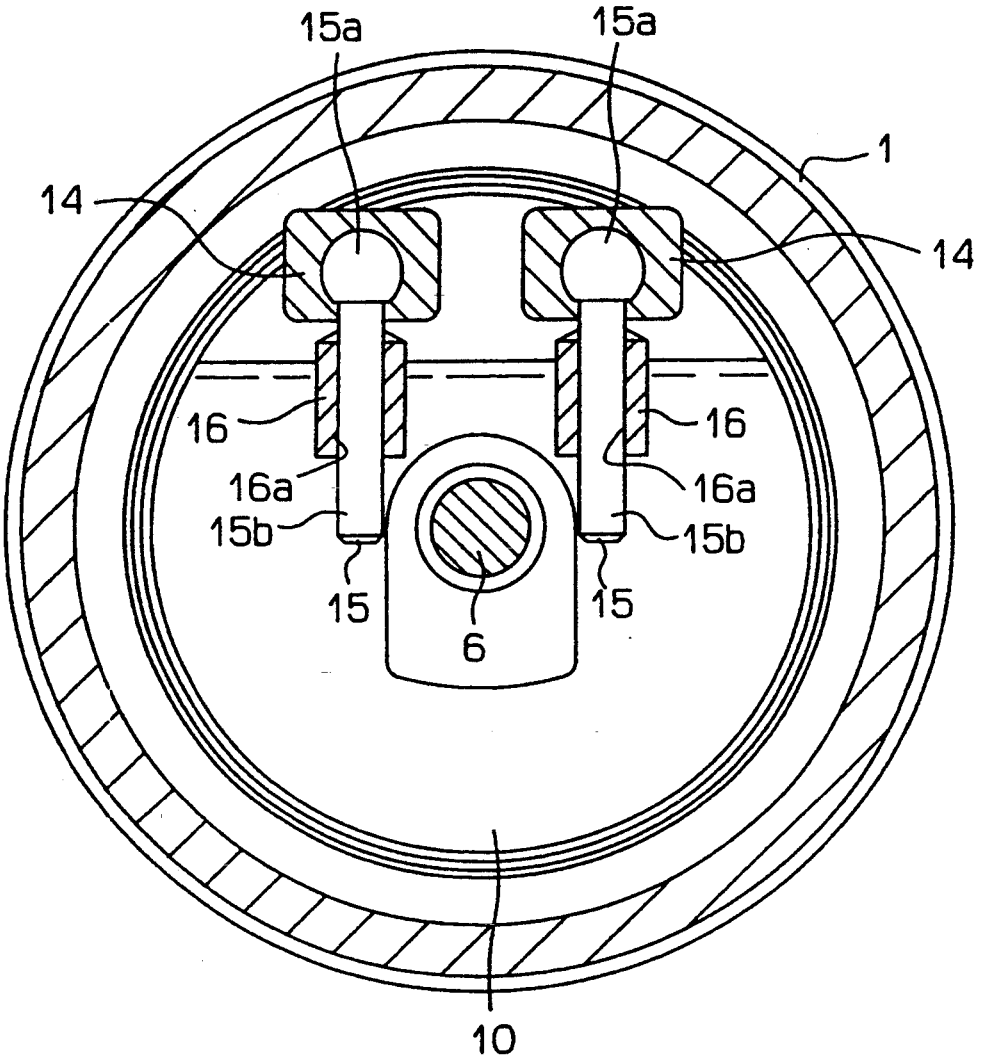

As shown in FIGS. 3 and 4, the hinge mechanism K is constructed with a pair of support arms 14, connecting pins 15 and bearing sections 16 of the rotary journal 13. The arms 14 are formed on the drive plate 10 on adjacent the periphery thereof and project toward the rear direction. Each one of the pins 15 includes a ball portion 15*a* which is rotatably engaged with the associate arm 14. Further, the bearing sections 16 include guide holes 16*a* in which rod portions 15*b* of the pins 15 are reciprocally movable, respectively.

As shown in FIG. 1, a swash plate 17 is fixed to the peripheral portion of the journal 13. The peripheral portion of the swash plate 17 is received via a pair of shoes 19 in recesses 18 formed in the proximal portions of the pistons 9, respectively.

The shoes 19 are slidable along the peripheral portion of the swash plate 17. In this way, the pistons 9 are retained at the peripheral portion of the swash plate 17. As the drive plate 10 rotates with the drive shaft 6 synchronously, the journal 13 and swash plate 17 are rotated with the drive plate 10, via the hinge mechanism K. The plate 17 is rotated with the surface inclined with respect to the shaft 6 and slides in the recess 18 via the pair of shoes, so that the pistons 9 reciprocate in the cylinder bores 1*a* in accordance with the inclination angle of the swash plate 17.

A suction chamber 21 and a discharge chamber 22 are defined by a partition 20 in the rear housing. A suction valve mechanism 23 and a discharge valve mechanism 24 are provided in the valve plate 4. When the pistons 9 reciprocate, refrigerant gas is sucked into the bores 1*a* from the suction chamber 21 through the suction valve mechanism 23, respectively. After the gas is compressed in the bores 1*a*, the gas is discharged into the discharge chamber 22 through the discharge valve mechanism 24. Control valve mechanism 25, 26 are provided in the rear housing 3. The control valve mechanism 25 opens or closes a supply passage (not shown) which communicates the discharge chamber 22 with the crank chamber 5. The control valve mechanism 26 opens or closes the discharge passage which communicates the crank chamber 5 with the suction chamber 21. The difference between the pressure in the crank chamber 5 and that in the suction chamber 21 is adjusted by the opening or closing operation of the control valve mechanism 26. Consequently, the stroke of the piston 9 is varied. The displacement of the compressor is controlled by regulating the inclination angle of the swash plate 17.

As shown in FIG. 1, an enlarged portion 29 is formed between the vicinity of the front edge of each cylinder bore 1*a* and the front portion of the center housing 1, and is expanded outward from the center housing 1, corresponding to the sliding movement of the proximal end of the piston. A piston guide surface 29*a* is formed in the inner periphery of the enlarged portion 29. A stopper 30 is integrally formed at the proximal portion of the piston 9, which protrudes radially and extends along the back-and-forth direction. The guide surface 29*a* guides the stopper 30.

Figure 2:
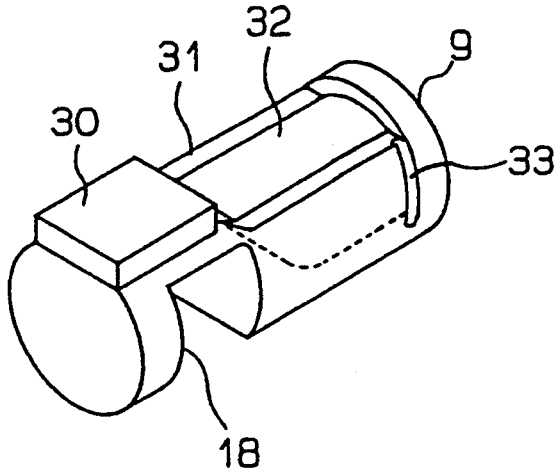

As shown in FIGS. 1 and 2, a cut-away portion 31 is formed at the circumference of the piston 9, by removing a portion of the piston 9 which is located facing in the same direction as the enlarged portion 29 side of the central housing (i.e., as seen from outside of the compressor). A hollow section 32 is formed in the central portion of the piston 9, and communicates with the cut-away portion 31. The hollow section 32 is communicable with the crank chamber 5, via the cut-away portion 31. A front inner surface of the hollow section 32 forms a slanted surface in a manner that it is closer to the piston head as it is closer to the shaft 6. As the opening of the cut-away portion 31 is enlarged by this slanted surface 32*a*, a large amount of gas can be introduced into the hollow section 32 from the crank chamber 5. A lubricating groove 33 circumferentially extends along the periphery of the piston 9, which corresponds to the inner end of the cut-away portion 31 at the rear side. The groove 33 initiates from the edge of the cut-away portion 31 and exists within a predetermined angle range. Lubricant oil contained in the refrigerant gas is introduced into the groove 33 and gives a lubrication between the outer circumferences of the pistons 9 and inner circumferences of the cylinder bores 1*a*.

According to a variable displacement compressor having the above-described structure, the operations will now be described.

As shown in FIG. 1, when the drive shaft 6 is driven by the engine, the drive plate 10 is rotated together with the drive shaft 6. The rotation is transferred to the rotary journal 13 and swash plate 17 through the hinge mechanism K including support arms 14, connecting pins 15 and bearing sections 16. The plate 17 is rotated with the surface inclined with respect to the shaft 6, so that the pistons 9 reciprocate in the cylinder bores 1*a*. As the pistons 9 are reciprocated, in correspondence with the rotational motion, the refrigerant gas sucked into the cylinder bore 1*a* from the suction chamber 21 is compressed, and then discharged to the discharge chamber 22. When the pistons 9 reciprocate, the stopper 30 also reciprocates along the guide surface 29*a*.

As shown in FIG. 1, a space P is defined between the rear peripheral surface 30*a* of the stopper 30 and the rear inner surface 29*b* of the guide surface 29*a*, which is maximized when the piston 9 is at the bottom dead center. Since the cut-away portion 31 and the hollow section 32 are formed to communicate the crank chamber 5 with the space P, the refrigerant gas containing lubricant oil in the crank chamber 5, in this condition, is led into the hollow section 32 through the cutaway portion 31, and also is led to the space P. As the piston 9 moves from the bottom dead center to the top dead center during the compression stroke, the volume of the space P decreases. Therefore, the misted oil contained in the refrigerant gas is supplied to the gap between the circumference of the piston 9 and the inner surface of the cylinder bores 1*a*, and the pistons 9 smoothly slide in the bores 1*a*.

As shown in FIG. 2, the groove 33 is formed in the circumference of the piston 9 which communicates to the hollow section 32. The groove 33 leads the oil in the refrigerant gas to the gap between the circumference of the piston 9 and the inner surface of the cylinder bores 1*a*. Therefore, the pistons 9 slide much smoother than before.

Figure 5:
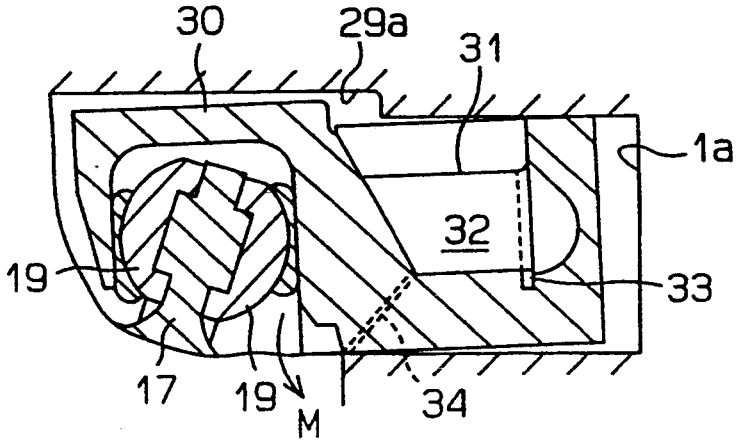
Figure 6:
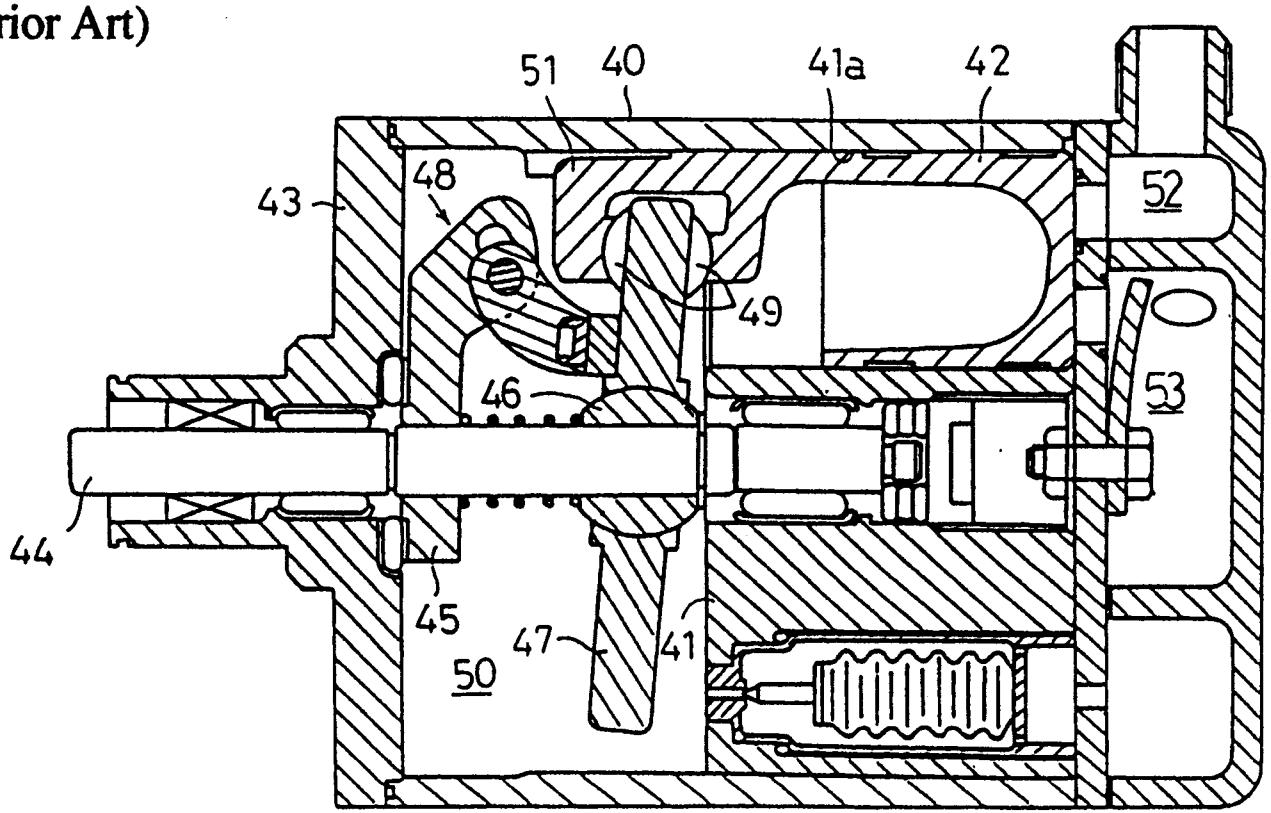
Fig.6 (Prior Art)
FIG. 6 is a longitudinal cross-sectional view of a conventional compressor.

As shown in FIG. 5, bending moment M is generated during the compression stroke in relation to the urging force of the swash plate 17, in the case of the single head piston type compressor. This bending moment M may increase the gap defined between the circumference of the piston 9 and a portion of the associate bore 1*a* at the shaft side. However, the groove 33 according to this embodiment is formed away from the circumference of the shaft 6 side of the piston 9 within the predetermined angle range and located at the housing 1 side. Therefore, even when the large gap described above is formed, the hollow section 32 never communicates with the cylinder bore 1*a*, through the groove 33 during the compression stroke. As a result, the compressed gas in the bore 1*a* is prevented from flowing back to the crank chamber 5 through the gap.

Although only one embodiment of the present invention has been described herein, it should be apparent to those skilled in the art that the present invention may be embodied in many other specific forms without departing from the spirit or scope of the invention. Particularly, it should be understood that the following modes are to be applied.

For example, as indicated by double dotted lines in FIGS. 1 and 5, a passage 34 can be formed in the piston 9 which communicates the hollow section 32 with the crank chamber 5 and opens to the hollow section 32 and the circumference of the pistons 9. As the misted oil can be introduced through the passage 34 to the part of the piston 9 which is strongly urged against the inner periphery of the bore 1*a* by the bending moment M, the favorable sliding characteristic of the piston 9 can be maintained.

Although the present invention is embodied in the swash plate type variable displacement compressor in the above-described embodiment, the present invention can be embodied in a swash plate type compressor with fixed displacement.

Therefore, the present examples and embodiments are to be considered as illustrative and not restrictive and the invention is not to be limited to the details given herein, but may be modified within the scope of the appended claims.

What is claimed is:

1. A piston guiding mechanism for use in a piston-type compressor of the type including a housing containing a cylinder block where the cylinder block has at least one bore in which a reciprocative piston is disposed, the piston having a central portion and a peripheral surface, whereby a refrigerant gas containing lubricating oil can be drawn into said bore from outside the compressor to be compressed within said bore and discharged from the compressor in response to reciprocating motion of said piston, said piston guiding mechanism comprising:

an oil transfer section extending radially from said central portion to said peripheral surface of said piston and including in said piston a longitudinally extending hollow section and a cut-away portion, the cut-away portion constituting a passage communicating with said hollow section;

said oil transfer section being movable between points in said housing and said bore during reciprocating motion of said piston for transferring said lubricant oil contained in said refrigerant gas from said point in the housing to said bore;

a radially extending projection formed on said peripheral surface of said piston and located adjacent an end of said hollow section and cut-away portion; and a guiding surface formed inside said housing for guiding said projection to slide smoothly along said guiding surface when said piston reciprocates.

2. The piston guiding mechanism according to claim 1, wherein said piston has an oil passage formed on said peripheral surface, which passage extends circumferentially over a predetermined arc, and said oil passage communicates with said oil transfer section and supplies said lubricant oil from said refrigerant gas to the space between said piston and said bore.

3. The piston guiding mechanism according to claim 1, wherein said piston includes a passage in communication with said oil transfer section and opening to said peripheral surface of said piston, said passage operating to supply said lubricating oil from said oil transfer section to said peripheral surface of said piston.

4. The piston guiding mechanism according to claim 3, wherein said passage opens to said peripheral surface of said piston at an opposing side to a position where said oil transfer section is formed.

5. The piston guiding mechanism according to claim 1, wherein said projection is constructed to prevent said piston from rotating around an axis thereof when said projection slides along said guiding surface.

6. The piston guiding mechanism according to claim 1, wherein said piston is a single-head type, and said piston executes suction, compression and discharge of said refrigerant gas at a head portion thereof.

* * * * *